US007481427B2

(12) United States Patent
Tokutsu

(10) Patent No.: US 7,481,427 B2
(45) Date of Patent: Jan. 27, 2009

(54) AUTOMATIC DOCUMENT FEEDER

(75) Inventor: Akihito Tokutsu, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 591 days.

(21) Appl. No.: 11/074,749

(22) Filed: Mar. 9, 2005

(65) Prior Publication Data

US 2006/0202404 A1 Sep. 14, 2006

(51) Int. Cl.
*G03G 15/00* (2006.01)

(52) U.S. Cl. ..... 271/186; 271/3.19; 271/225; 271/291; 271/65; 271/176; 271/902; 399/367; 399/374

(58) Field of Classification Search ..... 271/3.19, 271/225, 291, 298, 303, 65, 176, 184–186, 271/314, 902; 358/498; 355/23; 399/367, 399/374

See application file for complete search history.

(56) References Cited

U.S. PATENT DOCUMENTS 5,784,680 A * 7/1998 Taruki ..... 399/374
6,115,578 A * 9/2000 Mandel et al. ..... 399/367
6,354,589 B1 * 3/2002 Taruki et al. ..... 271/265.01
2001/0014234 A1 * 8/2001 Kono ..... 399/370
2007/0020007 A1 * 1/2007 Azuma ..... 399/367
2007/0264063 A1 * 11/2007 Sano et al. ..... 399/367

FOREIGN PATENT DOCUMENTS

JP 2002-220149 A 8/2002

* cited by examiner

*Primary Examiner*—Patrick H Mackey
*Assistant Examiner*—Jeremy Severson
(74) *Attorney, Agent, or Firm*—Foley & Lardner LLP

(57) ABSTRACT

An automatic document feeder of the present invention is provided with a turning/discharging path in a reversing path in order to read images on both sides of documents in lengths less than the main size and discharge in a discharging tray. Further, an aligning wall is provided to bump ends of documents discharged from the turning/discharging path against it. Thus, the documents of which both sides are read are discharged in the sequentially collated state at a high-speed and the aligned state.

9 Claims, 15 Drawing Sheets

AUTOMATIC DOCUMENT FEEDER

BACKGROUND OF THE INVENTION

1. Field of the Invention

The present invention relates to an automatic document feeder that is a mechanism to automatically supply documents to an image reading unit and in particularly, improves productivity in reading both sides of documents.

2. Description of Related Art

In automatic conveying units that supply documents automatically to an image reading unit such as a scanner and the like, some of them supply both the front and back sides of documents to an image reading unit. In such an automatic document feeder that is capable of supplying both sides of a document, it is desirable that a collating order of a document placed on a paper supply tray before reading the document is the same as the collating order of the document discharged on a paper discharge tray after completing the image reading in either cases to read a document image on one side only or document images on both sides.

In the Japanese Patent Application Publication No. 2002-220149, a technology is proposed to place documents on a paper supply tray with their front sides upward and supply them to an image reading unit first from a document put on the top in the case of reading both sides and after reading the front side, reverse the document for reading the back side and after reading the back side, reverse the document again by the reversing mechanism and discharge through the paper exit and thus, the document in the same collation order as that before supplying the documents with the front side downward is discharged onto a paper discharge tray.

However, in the conventional technology mentioned above, it is considered to discharge documents by collating them but the documents are discharged in the as-is state onto the discharging tray in the open state and alignment of discharged documents is not considered. As a result, it was necessitated for operator to align documents after completing the reading. Further, when documents are relatively small in size, the collation might become out of order on the paper discharge tray.

Accordingly, in an automatic document feeder capable of supplying both sides of documents to an image reading unit, it is demanded to discharge documents on the paper discharge tray in the same collation order and good aligned state as before the reading.

SUMMARY OF THE INVENTION

It is an object of this invention to improve productivity of the automatic document feeder for reading both sides of documents by improving alignment of supplied documents and discharged documents in the sequentially collated state after reading both sides of documents supplied by an automatic document feeder.

According to an embodiment of this invention, there is provided a automatic document feeder comprising paper supply tray means for placing documents with their front sides upward; document supply means for supplying the documents placed on the paper supply tray means in order from the top to a document reading unit; document discharging means for discharging the documents that are read in the document reading unit from the document reading unit; first gate means for sorting the documents discharged by the document discharging means in a first direction or a second direction; discharging tray means for placing the documents sorted in the first direction by the first gate means with the front sides downward; reversing means provided above the discharging tray means for conveying the documents sorted in the second direction by the first gate means reciprocally; wall-shaped aligning means provided at a side end of the first gate means of the discharging tray means; document re-conveying means for re-conveying the documents that are reversed and conveyed by the reversing means in a direction of the first gate means to the document reading unit; and turning/discharging means for turning the documents sorted in the second direction by the first gate means through the document re-conveying means in a conveying path of the reversing means to fall them on the discharging tray means from the reversing means and bumping ends of the documents in the falling direction against the aligning means.

DETAILED DESCRIPTION OF THE INVENTION

Figure 1:
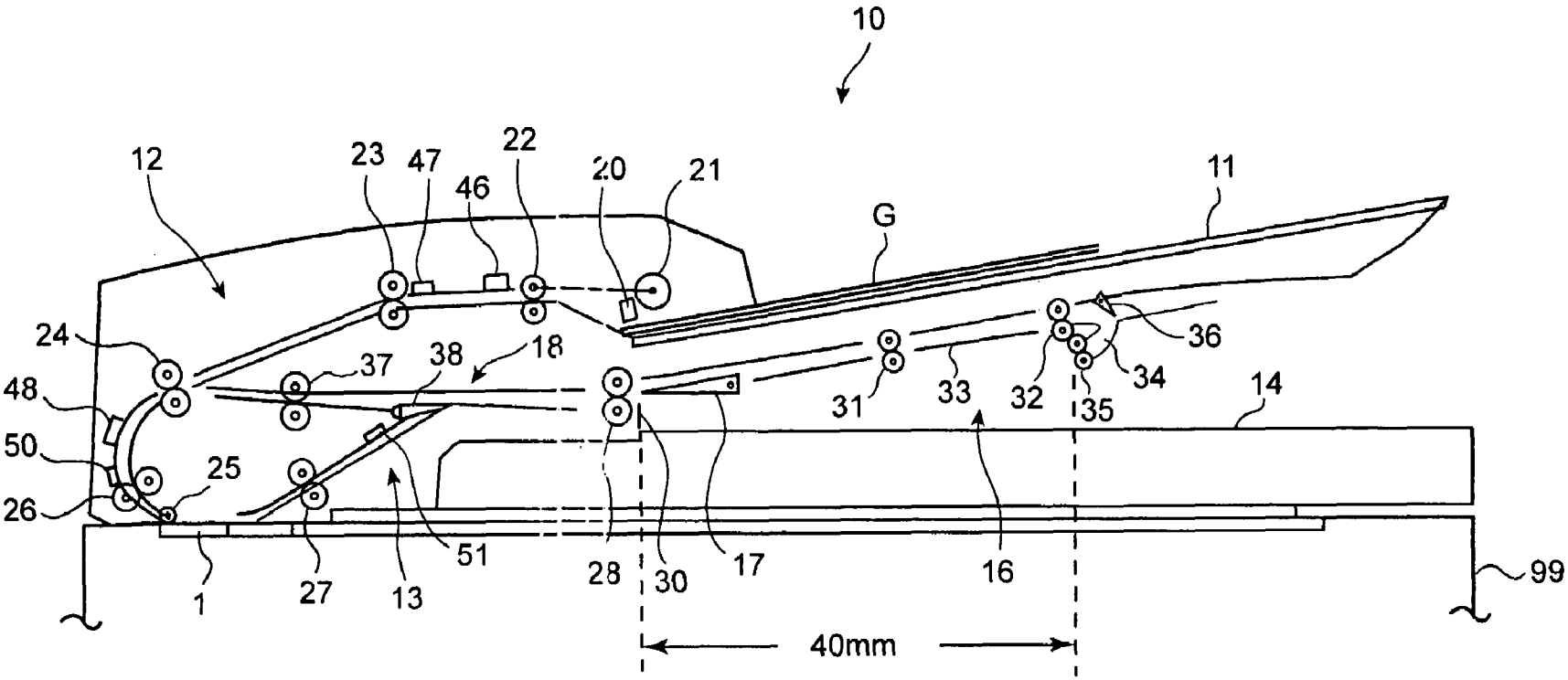
FIG. 1 is a construction diagram schematically showing an automatic document feeder in the embodiment of the present invention.

An embodiment of the present invention will be explained in detail referring to the attached drawings. FIG. 1 is a schematic construction diagram showing an automatic document feeder 10 that conveys documents to a reading unit 1 of an image reading unit 99 such as a scanner or an image forming apparatus. Automatic document feeder 10 sets, for example, A4 size (210 mm×297 mm) specified in the Japanese Industrial Standards (JIS) as the main size. (The main size here is the size of documents that are mainly conveyed). Automatic document feeder 10 has a paper supply tray 11 on which documents G are placed with the front sides upward, a document supply path 12 that is a document supply means to supply documents G to document reading unit 1 from paper supply tray 11, a document discharging path 13 that is a document discharging means to discharge documents G after completing the reading, and a first reversing gate 17 to sort documents discharged from document discharging path 13 in the first gate that is the direction of a discharging tray 14 or the second gate that is the direction of a reversing path 16 of the reversing means. Further, automatic document feeder 10 has a re-conveying path 18 that is a re-conveying means to supply the documents G of which front and rear sides are returned from reversing path 16 again to reading unit 1.

There is an empty sensor 20 provided above paper supply tray 11 to sense the presence of documents G. Document supply path 12 is provided with a pick-up roller 21 to take out documents G from paper supply tray 11, paper separation and supply rollers 22 to prevent take-out of double sheets of documents G, aligning rollers 23 to align the front edges of documents G, middle rollers 24 to transmit conveyed documents, pre-reading rollers 26, and a document holding roller 15. Document discharging path 13 has post-reading rollers 27 and first discharging rollers 28 that are rotated in the normal/reverse directions. An almost vertical aligning wall 30 that is an aligning means is provided at the side end of first discharging rollers 28 of discharging tray 14.

Reversing path 16 has first and second reversing rollers 31 and 32 that are reciprocally rotated and a turning-discharging path 34 in the U-shaped cross-sectional surface is formed at the middle of a conveying path 33 of reversing path 16 to U-turn and discharge documents G in the direction of discharging tray 14. At the discharging end of turn/discharging path 34, second discharging rollers 35 are provided. A distance from aligning wall 30 to discharging rollers 35 is set at 240 mm that is a little longer than A4 size that is the main size.

In conveying path 33, a second reversing gate 36 is provided to sort documents in the direction of turning-discharging path 34.

Re-conveying path is extending from first discharging rollers 28 that are reverse rotated to middle rollers 24 via re-conveying rollers 37. Re-conveying path 18 is provided with a third reversing gate 38 to lead documents G from first discharging rollers 28 in the direction of re-conveying rollers 37.

Figure 2:
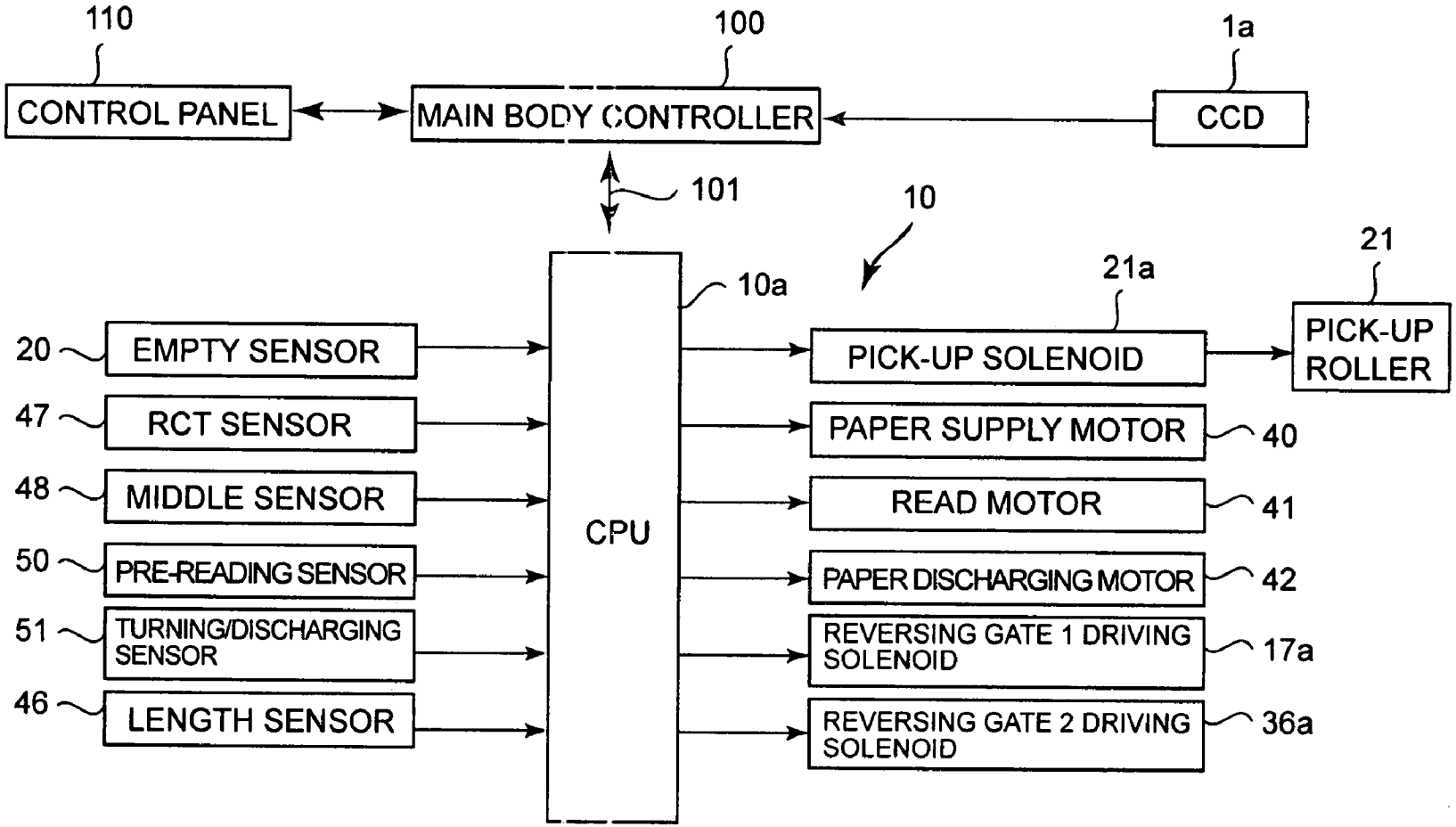
FIG. 2 is a block diagram showing a control system of the automatic document feeder in the embodiment of the present invention.

Pick-up rollers 1, separation and paper supply rollers 22 and aligning rollers 23 are driven by a paper supply motor 40 as shown in a block diagram of the control system of automatic document feeder 10 shown in FIG. 2. Middle rollers 24, pre-reading rollers 26 and post-reading rollers 27 are driven by a READ motor 41. First discharging rollers 28, first and second reversing rollers 31, 32, re-conveying rollers 37 and second discharging rollers 35 are driven by a discharging motor 42. First reversing gate 17 is operated by a first reversing gate driving solenoid 17*a* and a second reversing gate 36 is operated by a second reversing gate driving solenoid 36*a*. A third reversing gate 38 operates by empty weight.

On document supply path 12 shown in FIG. 1, a length sensor 46 to detect a length of a document G, an aligning sensor (RGT sensor) 47 to detect arrival of a document G to alignment roller 23, a middle sensor 48 to detect driving timings of a READ motor 41 and paper supply motor 40, and a pre-reading sensor 50 to detect a driving timing of paper discharge motor 42 are arranged. On document discharge path 13, a turning/discharging sensor 51 to detect a driving timing of READ motor 41 and paper discharge motor 42 is arranged.

A control panel 110 of an image forming apparatus is connected to a main body controller 100 that controls the entirety of an image reader 99 that has reading unit 1. Further, image data read by a CCD (Charge Coupled Device) 1*a* of reading unit 1 is input to main body control unit 100. Main body controller 100 controls a CPU 10*a* that is a control unit of automatic document feeder 10 through an input/output interface 101.

At the input side of CPU 10*a*, an empty sensor 20, length sensor 46, aligning sensor (RGT) sensor 47, middle sensor 48, pre-reading sensor 50 and discharging/reversing sensor 51 are connected. At the output side of CPU 10*a*, a pick-up solenoid 21*a* that oscillates pick-up roller 21, paper supply motor 40, READ motor 41, paper discharge motor 42, first reversing gate driving solenoid 17*a* and second reversing gate 36 are connected.

Figure 11:
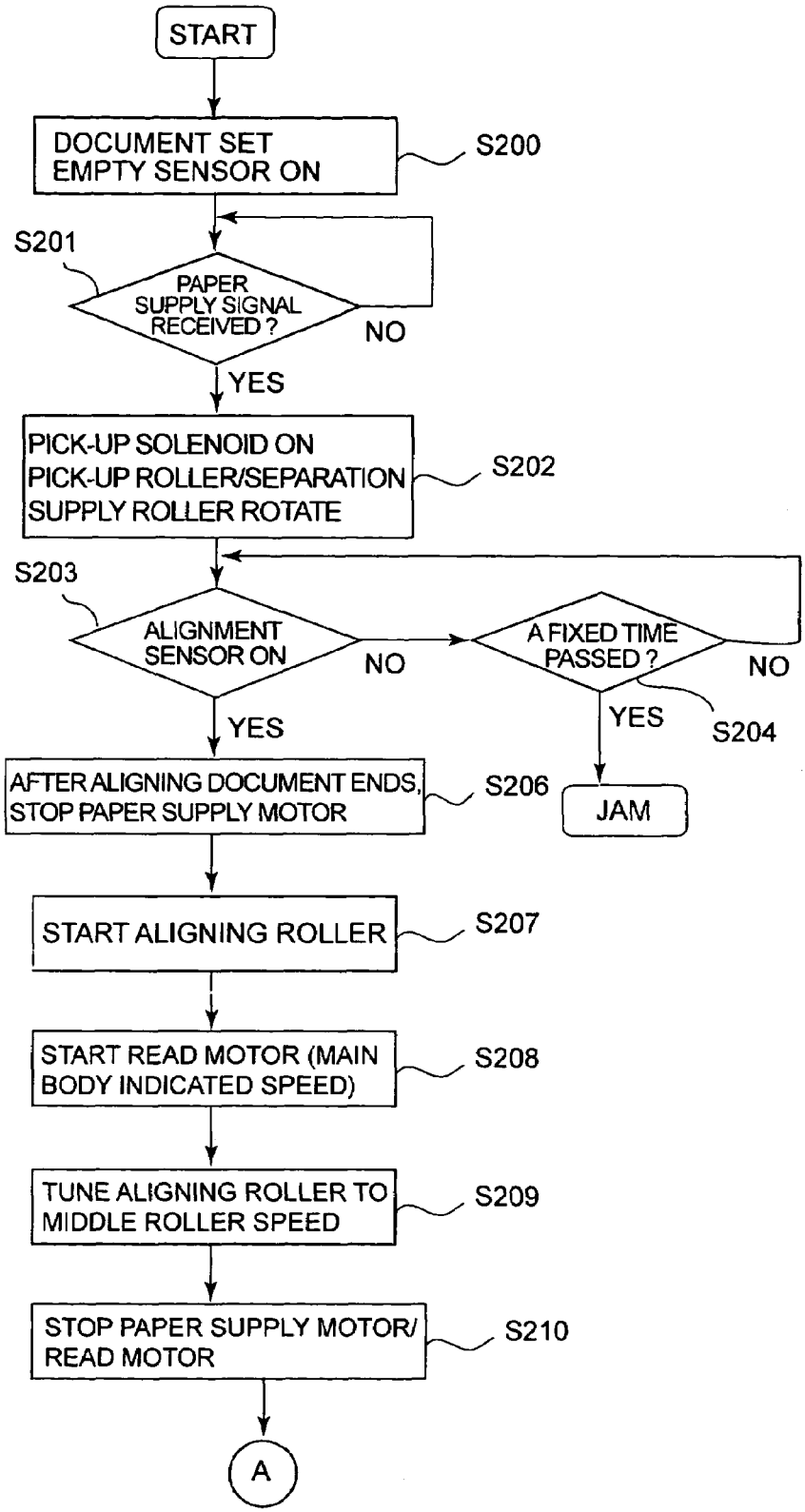
FIG. 11 is a flowchart showing the process from the setting of a document to the waiting for reading in the automatic document feeder in the embodiment of the present invention.
Figure 12:
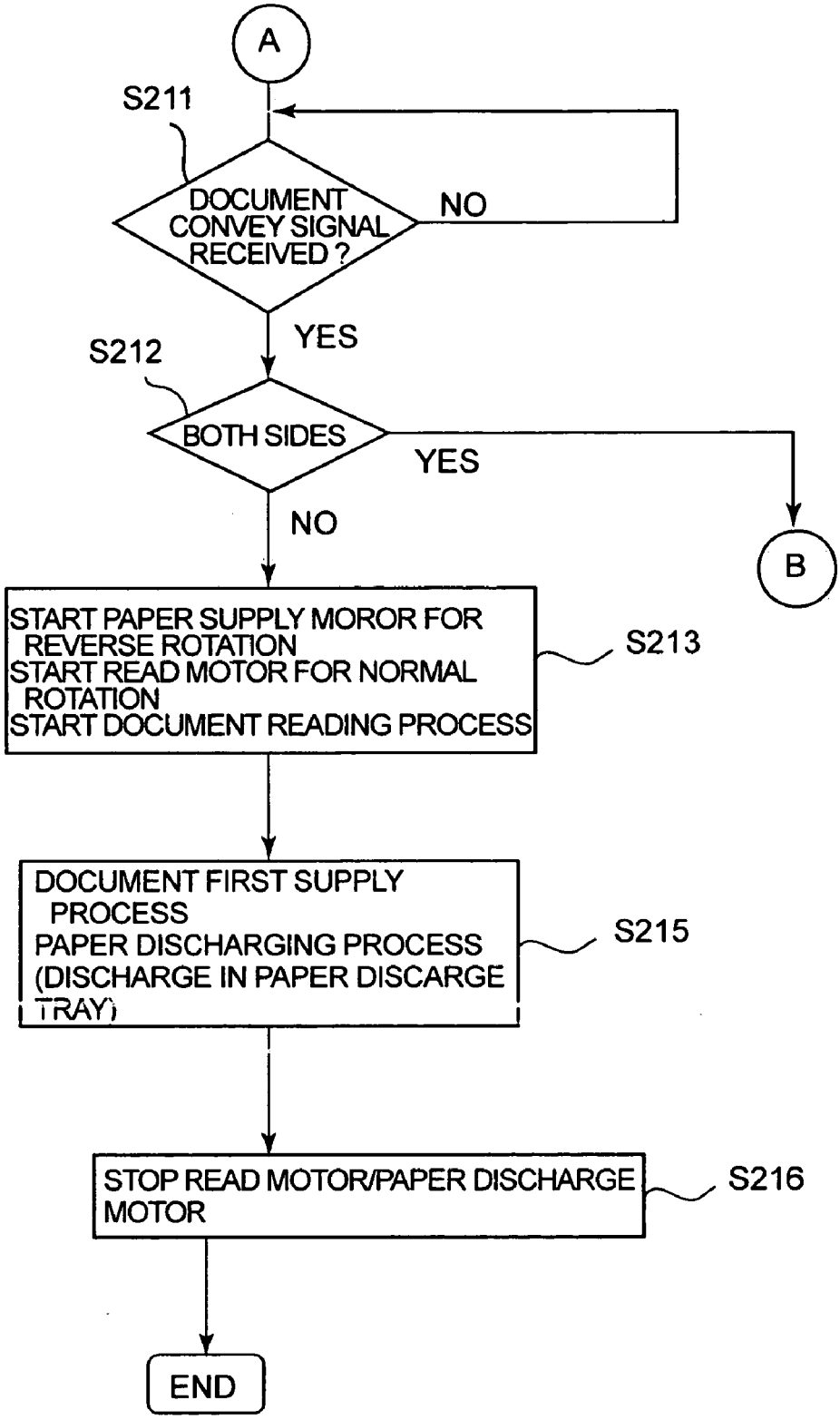
FIG. 12 is a flowchart showing the one-side reading in the automatic document feeder in the embodiment of the present invention.
Figure 13:
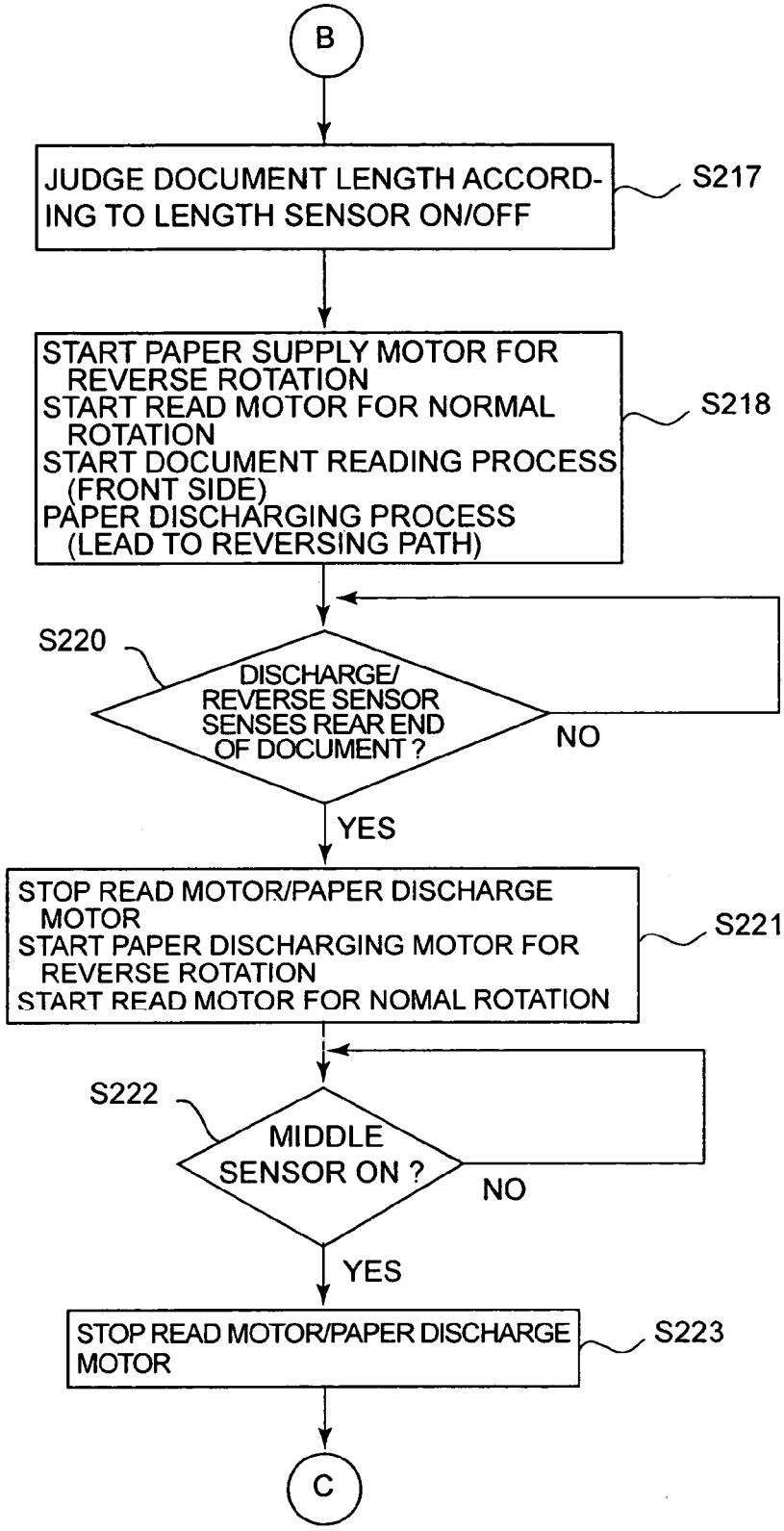
FIG. 13 is a flowchart showing the process from the rear surface reading of a document in the both side reading in the automatic document feeder in the embodiment of the present invention.
Figure 14:
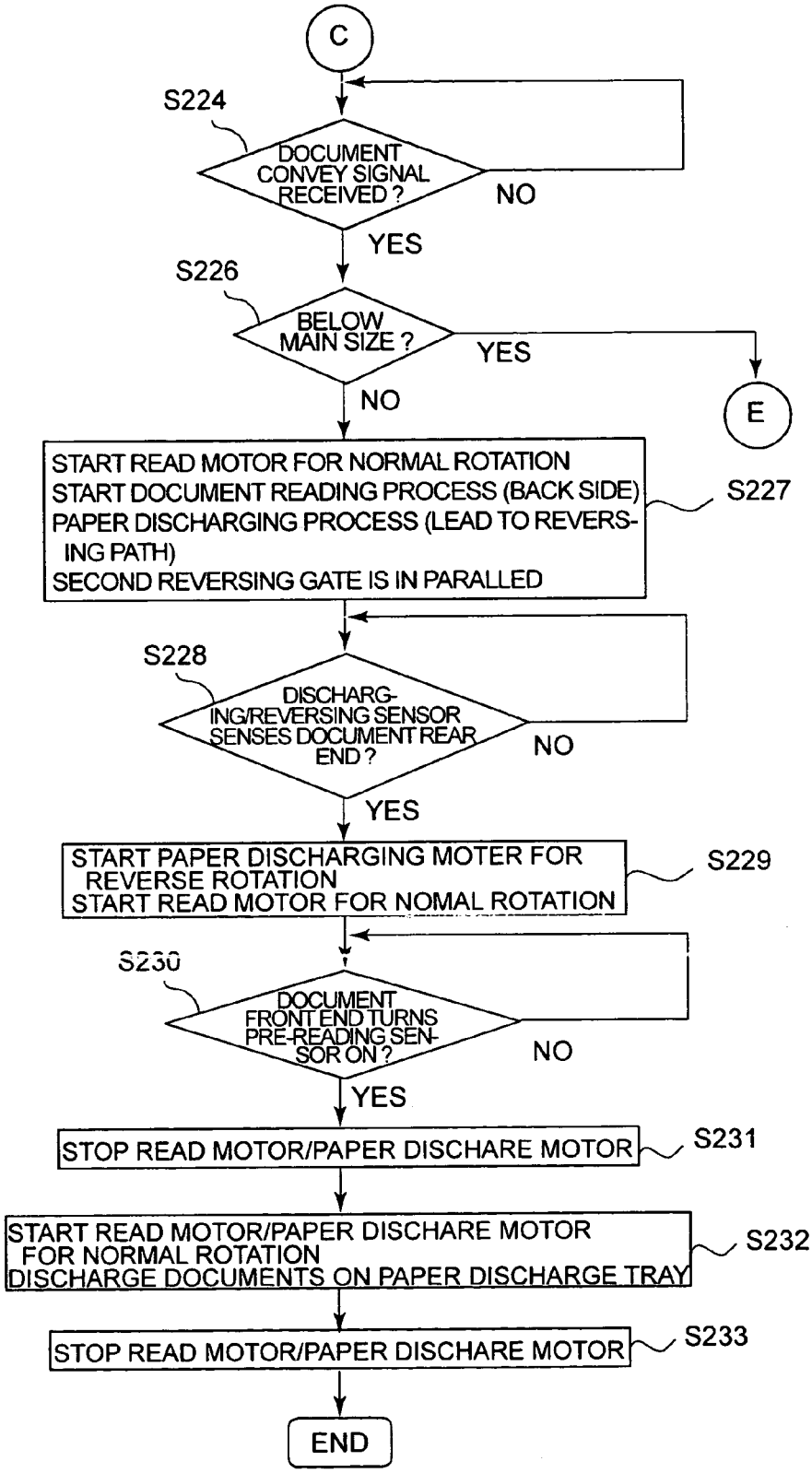
FIG. 14 is a flow chart showing the discharge of a document by way of the re-conveying path after completing the back side reading in the both side reading in the automatic document feeder in the embodiment of the present invention.
Figure 15:
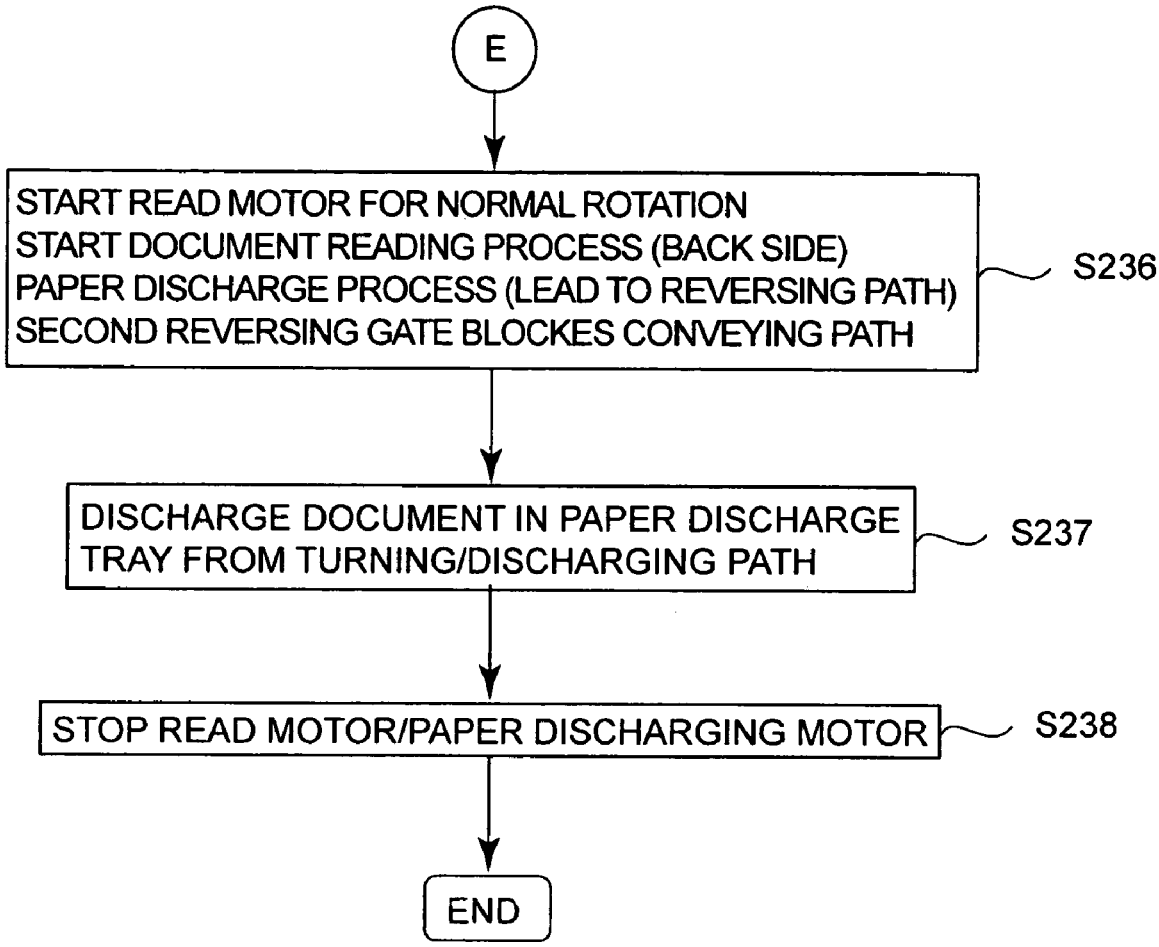
FIG. 15 is a flowchart showing the document discharge by way of the turning discharge path after completing the back side reading in the both side reading in the automatic document feeder in the embodiment of the present invention.

Next, the document G conveying process by automatic document feeder 10 will be explained. As shown in the flowchart in FIG. 11, when a document G is first placed in paper supply tray 11 in Step 200, empty sensor 20 is turned ON and a document set on signal is transmitted to main body controller 100. Further, an operator sets whether the convey of document G by automatic document feeder 10 is one side conveying or both side conveying jointly with various image forming conditions through control panel 110.

When a paper supply signal is received from main body controller 100 (Step 201), pick-up solenoid 21 is turned on, paper supply motor 40 is started to rotate in the normal direction, pick-up roller 21 and paper separation/supply rollers 22 are rotated (Step 202) and documents G are supplied in the arrow direction α.

Thereafter, in Step 203, it is detected whether alignment sensor 47 is turned on. In Step 204, when it is detected that a specified time passed without turning alignment sensor 47 on, it is judged that the document jam is taken place. In Step 203, alignment sensor 47 is turned on and after alignment rollers 23 are driven for a certain fixed number of pulses and the front edges of documents G are aligned, paper supply motor 40 is stopped (Step 206).

After a fixed time passed, paper supply motor 40 is started to rotate in the reverse direction and aligning rollers 2 are rotated at a specified high speed (Step 207). At the almost same time as the start of aligning rollers 23, READ motor 41 is started. At this time, middle rollers 24 and pre-reading rollers 26 are rotated at a speed and a magnified speed directed from main controller 100 (Step 208). Alignment rollers 23 are aligned to the same speed of middle rollers at the time when a documents G is conveyed for a fixed number of pulses from the time when alignment rollers 23 are started by the start of paper supply motor 40 (Step 209). At this time, a document G reaches short of middle roller 24. When a document was driven for a fixed number of pulses after middle sensor 48 is turned on, paper supply motor 40 and READ motor 41 are stopped (Step 210).

Figure 3:
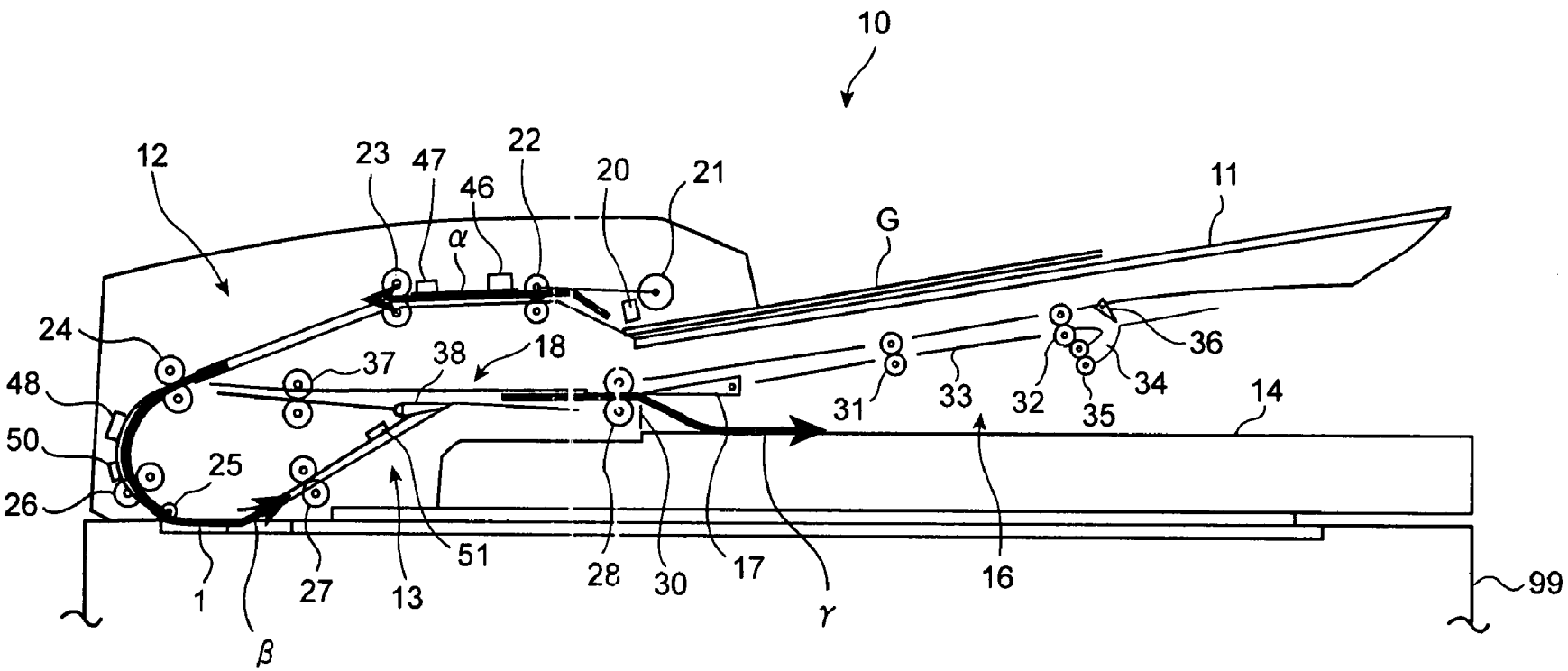
FIG. 3 is a schematic explanatory diagram showing the one side image document conveying of the automatic document feeder of the embodiment of the present invention.

When a document conveying signal is received from main body controller 100 (Step 211), it is checked whether the reading is one side only or both sides in Step 212. In the case of one side reading, the process proceeds to Step 213. In Step 213, paper supply motor 40 starts to rotate in the reverse direction, READ motor 41 starts to rotate in the normal direction and alignment rollers 23, middle rollers 24, pre-reading rollers 26 and post-reading rollers 27 are rotated to supply documents G in the arrow direction β shown in FIG. 3 and the document reading process starts.

When there is a next document to be processed after the rear end of a current document G passed alignment rollers 23 during the document reading, paper supply motor 40 is once stopped. Then, paper supply motor 40 is started for normal rotation, pick-up roller 21 and separation/paper supply rollers 22 are rotated and the process starts to supply the next document first. In parallel with this, paper discharge motor 42 is rotated to discharge paper (Step 215). At this time, first reversing gate 17 is switched to discharge a document G in the arrow direction Y shown in FIG. 3 by first reversing gate driving solenoid 17*a,* and document G is discharged in paper discharging tray 14 with the front surface downward. Thereafter, READ motor 41 and paper discharge motor 42 are stopped (Step 216) and the one side reading process is terminated. This one side reading process is repeated and documents G collated sequentially are accumulated on paper discharging tray 14.

On the other hand, when the both side reading is judged in Step 212, the process proceeds to Step 217 in order to make the both side reading. In Step 217, it is judged whether documents G are below A4 size that is the main size depending on whether length sensor 46 was ON when paper supply motor 40 and READ motor 41 were stopped in Step 210. If length sensor 46 was OFF, documents G are judged as being in length below the main size and when length sensor 46 was ON, the length of documents G is judged to be longer than the main length.

Figure 4:
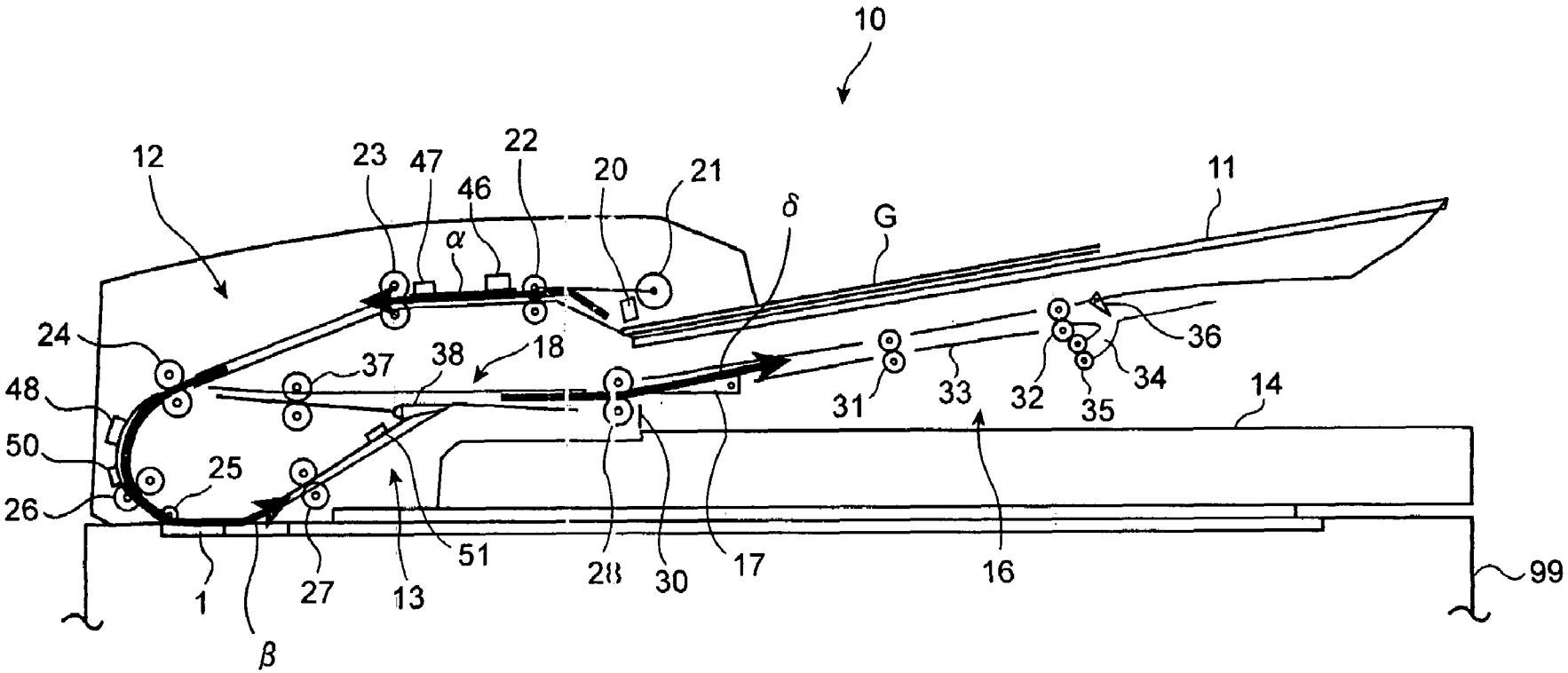
FIG. 4 is a schematic explanatory diagram showing the conveying of documents when reading the front side of the both side conveying of the automatic document feeder in the embodiment of the present invention.

Then, likewise Step 213 for the one side reading, paper supply motor 40 is started to rotated in the reverse direction, and motor 41 is started for the normal rotation to rotate alignment rollers 23, middle rollers 24, pre-reading rollers 26 and post-reading rollers 27, a document G is supplied in the arrow direction β, the document reading process is started to read the front side of the document G. In parallel with this, first reversing gate 17 is switched to discharge document G in the arrow direction δ shown in FIG. 4 by first reversing gate driving solenoid 17*a,* and the document G is led to conveying path 33 of reversing path 16 by rotating paper discharge motor 42 (Step 218).

Figure 5:
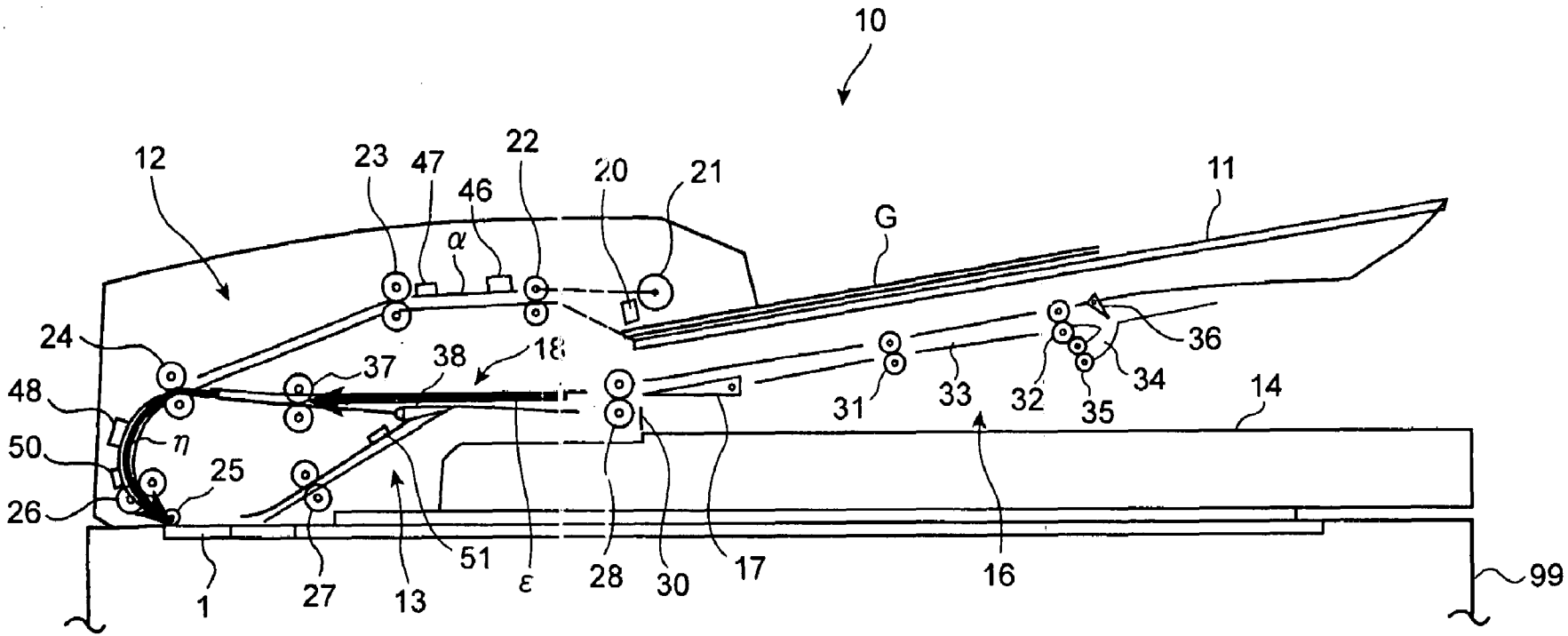
FIG. 5 is a schematic explanatory diagram showing the document conveying when both side images are conveyed again in the automatic document feeder in the embodiment of the present invention.

When the rear end of a document is detected by turning/discharging sensor 51 in Step 220, READ motor 41 and paper discharge motor 42 are stopped at the time when the document G was conveyed for a fixed distance. Then, paper discharge motor 42 is rotated in the reverse direction, READ motor 41 is again started for normal rotation and document G is led in the arrow directions ϵ and η shown in FIG. 5 by reverse rotating first and second reversing rollers 31 and 32 and first paper discharging rollers 28 (Step 221). At this time, third reversing gate 38 is actuated to lead the document G to re-conveying path 18 by empty weight. When middle sensor 48 is turned on while the document G is conveyed in the arrow direction η (Step 222), after driving for a fixed pulses, READ motor 41 and paper discharge motor 42 are stopped (Step 223).

Figure 6:
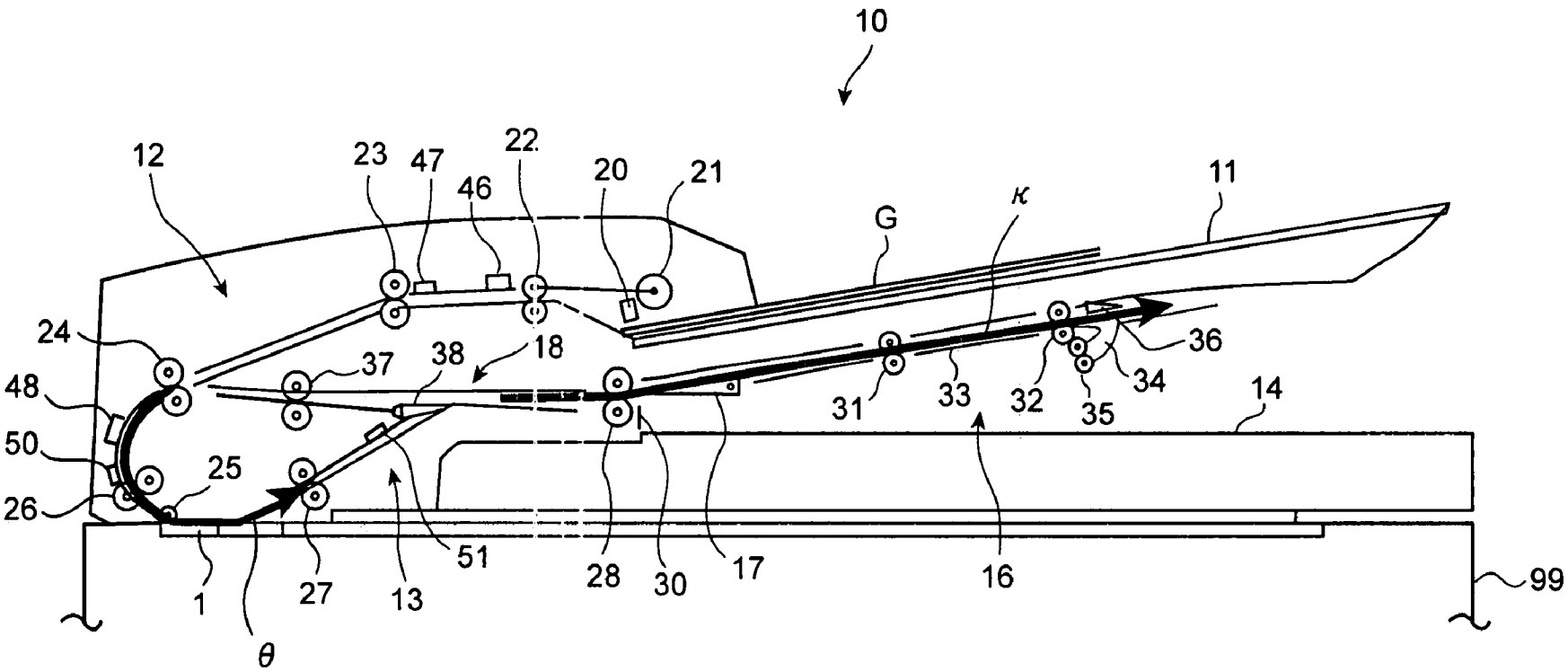
FIG. 6 is a schematic explanatory diagram showing the document conveying when reading the back side in the both side image conveying in the automatic document feeder in the embodiment of the present invention.

When a document conveying signal is received from main body controller 100 (Step 224), it is checked whether the document G is in a length below the main size in Step 226. When the document G is in a length not shorter than the main size but longer than A4 size, the process proceeds to Step 227. In Step 227, READ motor 41 is started for the normal rotation and the document G is supplied in the arrow direction θ shown in FIG. 6 by the rotation of middle rollers 24, pre-reading rollers 26 and post-reading rollers 27 and the reverse side of the document G is read. In parallel with this, first reversing gate 17 is set so as to discharge the document G in the arrow direction κ shown in FIG. 6 by first reversing gate driving solenoid 17*a* and the document G is led to conveying path 33 of reversing path 16 by rotating paper discharge motor 42. At this time, second reversing gate 36 is set in parallel with conveying path 33 by second reversing gate driving solenoid 36*a* to lead the document G that is discharged in conveying path further in the extended direction of conveying path 33.

When discharging/reversing sensor 51 detects the rear end of a document G in Step 228, READ motor 41 and paper discharge motor 42 are stopped at the time when the document G was conveyed for a fixed distance. Then, in order to reverse the front and back sides of the document G, paper discharge motor 42 is started for the reverse rotation and READ motor is started again for the normal rotation and the document G is led in the direction of re-conveying path 18 by reverse rotating first and second reversing rollers 31 and 32 and first paper discharging rollers 28 (Step 229). At this time, third reversing gate 38 acts to lead the document G to re-conveying path 18 by empty weight.

Figure 7:
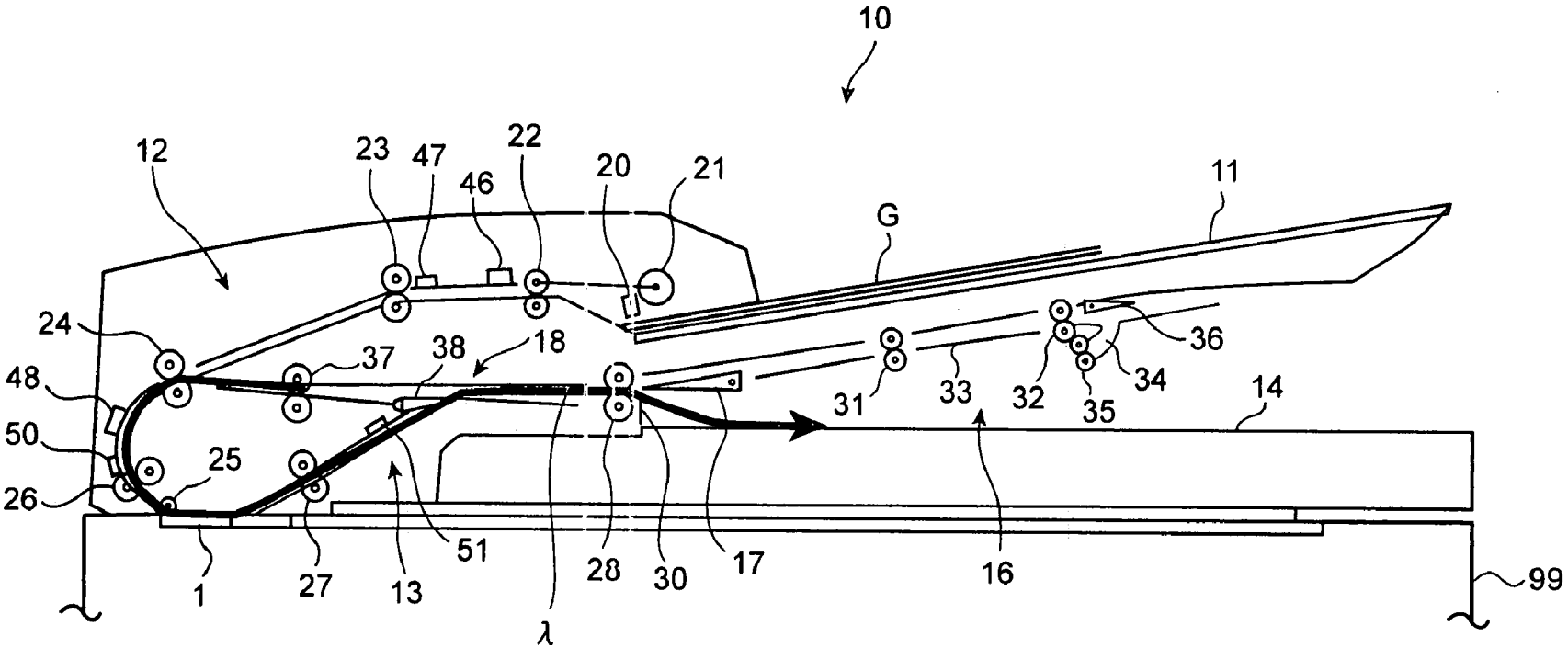
FIG. 7 is a schematic explanatory diagram showing the conveying of a document when discharging it by way of a re-conveying path of the both side conveying in the automatic document feeder in the embodiment of the present invention.

READ motor 41 and paper discharge motor 42 are stopped (Step 231) at the position to where the document G is conveyed for a fixed distance after the front end of the document G turned pre-reading sensor 50 on (Step 230). Thereafter, first reversing gate 17 is switched to discharge the document G in the arrow direction λ shown in FIG. 7 by first reversing gate driving solenoid 17*a,* and by starting READ motor 41 and paper discharge motor 42 for the normal rotation (Step 232), the document G is discharged in paper discharge tray 14 with the front side downward. Thereafter, READ motor 41 and paper discharge motor 42 are stopped (Step 233) and the both side reading process of a document G that is longer than the main size is terminated. By repeating this both side reading process, documents G collated in order are accumulated on paper discharge tray 14 with the front sides downward.

On the other hand, when the length of a document G was judged to be below the main size in Step 226, the process proceeds to Step 236. In Step 236, READ motor 41 starts for the normal rotation to supply a document G in the arrow direction θ shown in FIG. 8 by rotating middle rollers 24, pre-reading rollers 26 and post-reading rollers 27 for reading the rear surface of a document. In parallel with this, first reversing gate 17 is set so as to discharge a document G in the arrow direction μ shown in FIG. 8 by first reversing gate driving solenoid 17*a,* and the document G is led to conveying path 33 of reversing path 16 by rotating paper discharge motor 42.

Figure 8:
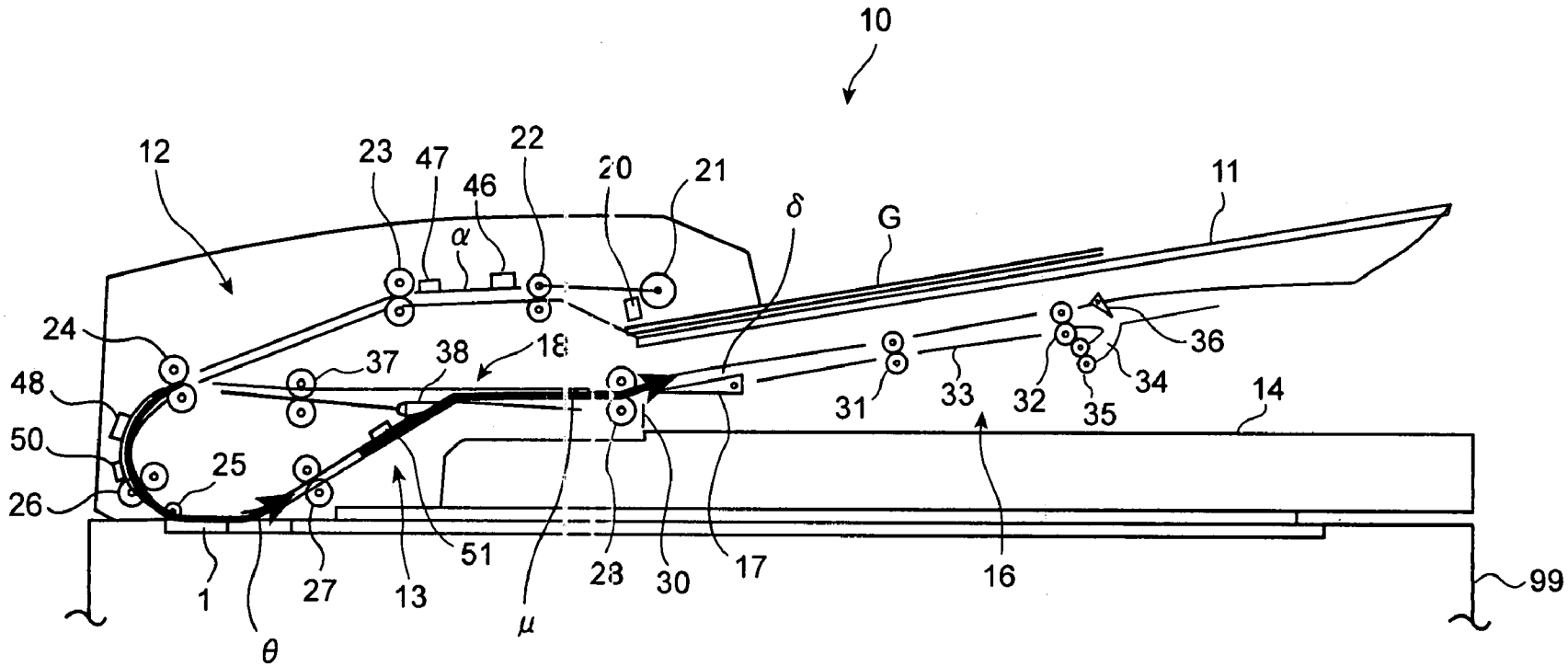
FIG. 8 is a schematic explanatory diagram showing the document conveying when reading the back side of a document that is longer than the main size for the both side convey in the automatic document feeder in the embodiment of the present invention.
Figure 9:
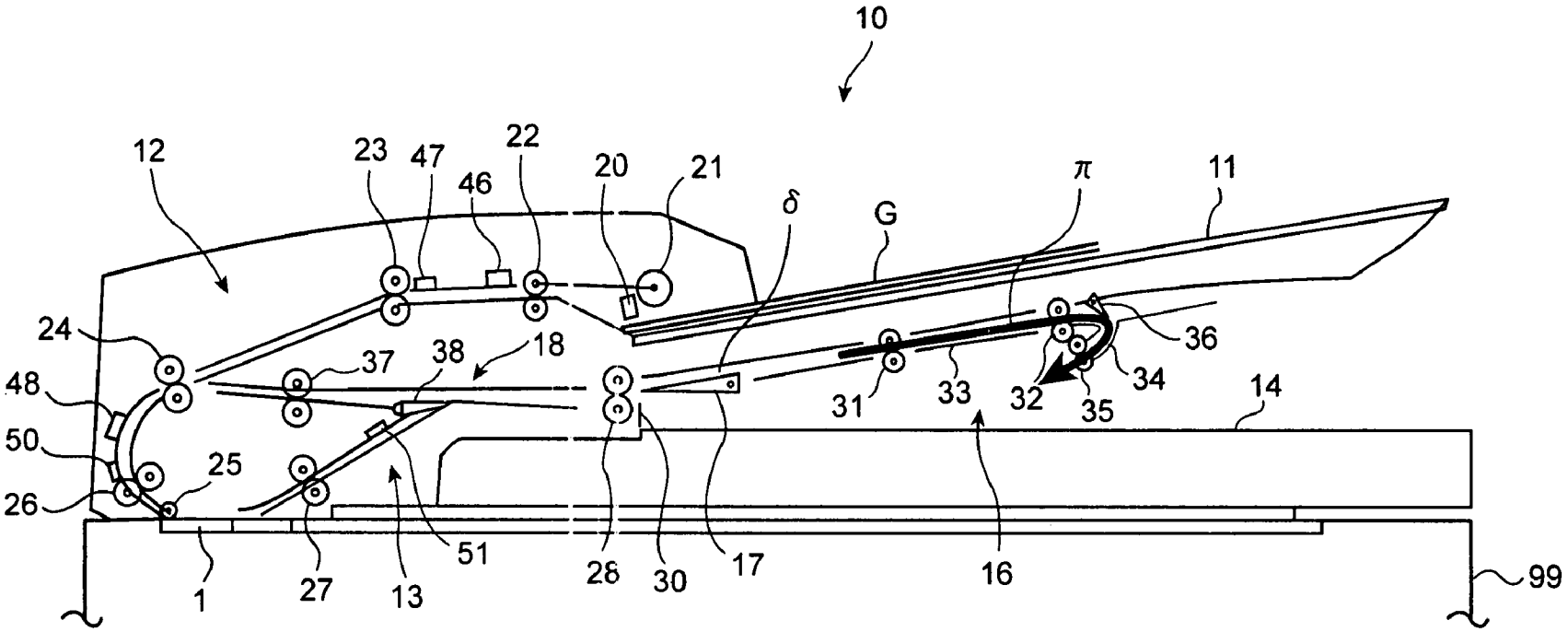
FIG. 9 is a schematic explanatory diagram showing the document conveyance when discharging by U-turning a document longer than the main size of the both side conveying in the automatic document feeder in the embodiment of the present invention.
Figure 10:
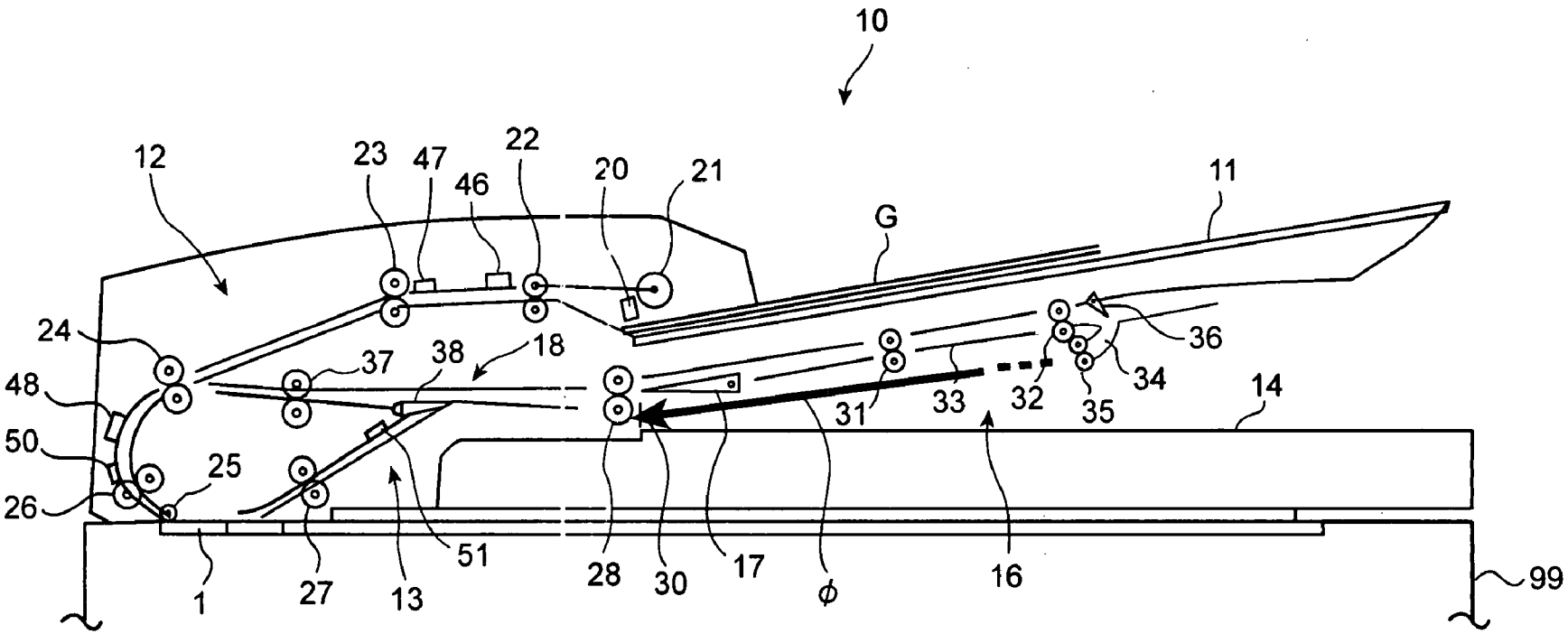
FIG. 10 is a schematic explanatory diagram showing the alignment of a document longer than the main size for the both side conveying in the automatic document feeder in the embodiment of this invention.

At this time, second reversing gate 36 was switched to close conveying path 33 by second reversing gate driving solenoid 36*a* as shown in FIG. 8. Thus, the documents G discharged into conveying path 33 are U-turned in the direction of turning/discharging path 34 by second reversing gate 36 and the front and reverse sides of the document Gs are reversed. After this, the documents G are conveyed in the arrow direction ϕ shown in FIG. 10 by second paper discharge roller 35 and discharged in paper discharge tray 14 with the front sides downward (Step 237). By this discharge of the documents in the arrow direction ϕ, the front ends of the documents G bump against an aligning wall 30 and the documents G are aligned.

Thereafter, READ motor 41 and paper discharge motor 42 are stopped (Step 238) and the both side reading process of documents G of which lengths are below the main size is terminated. By repeating this both side reading process, documents G sequentially collated with the front sides downward bump against alignment wall 30 and accumulated on paper discharge tray 14 in the aligned state.

According to this embodiment, documents G supplied to conveying unit 1 by automatic document feeder 10 are all accumulated in the sequentially collated state with the front sides downward on paper discharge tray 14 after completing the image reading irrespective of one side reading or both side reading. Furthermore, in the case of documents G of which both sides are to be read and lengths are shorter than the main size, it is possible to discharge them on paper discharge tray 14 by reversing the front and reverse sides by turning them through turning/discharging path 34 from reversing path 16 after reading their reverse sides. Accordingly, it is not necessary to reverse the front and reverse sides by returning documents G in the direction of re-conveying path 18 from reversing path 16 after completing the reading of the reverse sides of the documents G and the high discharging speed can be obtained. Further, it is possible to align documents G by bumping the ends of the documents against aligning wall 30 when discharging the documents by U turning through turning/discharging path 34 and improve conveying efficiency of the documents when conveying after reading both sides of the documents.

Further, this invention is not restricted to the embodiment described above but can be modified variously within the scope thereof. For example, sizes of documents discharged using the turning/discharging path are not restricted and can be optional when smaller than a letter size (215.9 mm×279.4 mm) or a document can be in the length of the document conveying direction, and the document main size can be set optionally as required by user. Further, a distance from the turning/discharging path to the aligning wall is not restricted if documents less than the main size could be aligned satisfactorily. Further, the curvature of the curve of the turning/discharge path is not limited and for example, a curve can be set optionally according to a document conveying velocity.

According to the present invention as described above in detail, the documents of which both sides are read are discharged in the discharging tray by turning from the reversing path and bumping against the aligning wall. Thus, the discharging velocity of the documents can be speed-up when reading both sides. Further, it is possible to discharge the documents collated in order in the aligned state and the conveying efficiency in the both side reading can be improved.

What is claimed is:

1. An automatic document feeder comprising:

paper supply tray means for placing documents with their front sides upward;

document supply means for supplying the documents placed on the paper supply tray means in order from the top to a document reading unit;

document discharging means for discharging the documents that are read in the document reading unit from the document reading unit;

first gate means for sorting the documents discharged by the document discharging means in a first direction or a second direction;

discharging tray means for placing the documents sorted in the first direction by the first gate means with the front sides downward;

reversing means provided above the discharging tray means for conveying the documents sorted in the second direction by the first gate means reciprocally;

wall-shaped aligning means provided at a side end of the first gate means of the discharging tray means;

document re-conveying means for re-conveying the documents that are reversed and conveyed by the reversing means in a direction of the first gate means to the document reading unit; and turning/discharging means for turning the documents sorted in the second direction by the first gate means through the document re-conveying means in a conveying path of the reversing means to drop them on the discharging tray means from the reversing means and bumping ends of the documents in the falling direction against the aligning means, wherein the reversing means has second gate means for sorting the documents on the conveying path of the reversing means in the direction of the turning/discharging means.

2. The automatic document feeder as claimed in claim 1, wherein the turning/discharging means has the U-shaped cross-section.

3. The automatic document feeder as claimed in claim 1, wherein a length of the document dropped on the discharging tray means by the turning/discharging means is shorter than a distance from the aligning means to an exit of the turning/discharging means.

4. The automatic document feeder as claimed in claim 1, wherein a length of the document dropped on the discharging tray means by the turning/discharging means is shorter than a length of a main size.

5. The automatic document feeder as claimed in claim 4, wherein the main size is slightly longer than 210 mm.

6. The automatic document feeder as claimed in claim 4, wherein the main size is slightly longer than 215.9 mm.

7. The automatic document feeder as claimed in claim 4, wherein a distance from the aligning means to the exit of the turning/discharging means is longer than a length of the main size.

8. The automatic document feeder as claimed in claim 1, wherein the document supply means has length sensor means for detecting the lengths of the documents.

9. The automatic document feeder as claimed in claim 1, wherein the first gate means sorts the documents in accordance with the size of the documents.

* * * * *